United States Patent [19]

Weaver

[11] 4,070,963

[45] Jan. 31, 1978

[54] IMPACT LINE PRINTER

[75] Inventor: John H. Weaver, Encino, Calif.

[73] Assignee: Anadex, Inc., Chatsworth, Calif.

[21] Appl. No.: 676,094

[22] Filed: Apr. 12, 1976

[51] Int. Cl.[2] ..... B41J 9/38

[52] U.S. Cl. ..... 101/93.29; 271/273; 101/93.48

[58] Field of Search ..... 101/93.29–93.34, 101/93.48; 197/127, 114, 133 R, 138; 271/273, 274, 266

[56] References Cited

U.S. PATENT DOCUMENTS

| | | | |
|---|---|---|---|
| 2,787,210 | 4/1957 | Shepard | 101/93.31 |
| 3,301,177 | 1/1967 | Shepard | 101/93.33 |
| 3,428,308 | 2/1969 | Bernard | 271/273 |
| 3,724,366 | 4/1973 | Murthy et al. | 101/93.31 |
| 3,828,911 | 8/1974 | Soderstrom | 197/114 R |
| 3,951,061 | 4/1976 | Bremmer et al. | 101/93.29 |

OTHER PUBLICATIONS

Luoma, IBM Technical Disclosure Bulletin, vol. 17, No. 1, June, 1974, pp. 340–341.

*Primary Examiner*—Edward M. Coven
*Attorney, Agent, or Firm*—Knobbe, Martens, Olson, Hubbard & Bear

[57] ABSTRACT

An impact line printer having a plurality of high velocity, small mass pivoted print hammers. Both a high print density and an unusually high impact printing force is achieved by actuating the hammers by a corresponding plurality of closely packed solenoids whose diameters are substantially larger than the spacing of the print hammers. These solenoids are mounted in the same vertical space but engage their associated print hammers a predetermined distances $S_1$ and $S_2$ from the hammer pivot axis. Appropriate selection of these distances $S_1$ and $S_2$ achieves uniform printing pressures from all of the hammers while using identical solenoids and identical drive currents. A paper engaging clamp includes a driven drive roller mounting a pair of resilient O-rings. A pair of pinch rollers, rotatably mounted on pivoted plastic lever arms, are adapted to clamp the paper or other printing medium between the rollers and the O-rings upon application of a force to the lever arms. The resiliency of the lever arm enables print media of varying thickness to be readily incorporated in printers constructed in accordance with this invention. A simplified pawl and ratchet wheel assembly employing a single spring is used to advance the drive roller. A platen sub-assembly comprises a unitary platen member molded of plastic and including a series of comb-like guides for the print hammers. The top surface of the platen supports the printing media within the impact line printer and the plurality of print hammers as well as the pinch roller support arms are pivoted within the platen member.

12 Claims, 16 Drawing Figures

| TESTS REQUESTED | COMMENTS: | USE PATIENTS IDENTIFICATION PLATE IN |
|---|---|---|
| ☐ BLOOD GAS PANEL<br>☐ CO-OXIMETER PANEL<br>☐ HEMATOCRIT<br>☐ $O_2$ CONTENT<br>☐ $P_{50}$ | | |

| | | |
|---|---|---|
| PATIENT TEMP. °C | ☐ ARTERIAL BLOOD SITE: ☐ VENOUS BLOOD SITE: | TEST RESULTS: pH, $PCO_2$, $PO_2$, BE, $HCO_3$, $CO_2Ct$, Hb; HbCO, $HbO_2$, Hct, $O_2$ CONTENT, $P_{50}$ |
| TIME SAMPLE DRAWN AM PM | ____% INSPIRED OXYGEN<br>RESPIRATOR | |

30 31 32 33

FIG.3.

FIG.4.

Hematology Form

CBC ☐ WBC ☐ DIFF ☐
RBC ☐ HCT ☐ HGB ☐
DATE ALL ☐

ROUTINE ☐
PRE-OP ☐
EMGNCY ☐
TECHNICIAN

| TEST | NORMS |
|---|---|
| . | WBC X $10^3$ |
| . | RBC X $10^6$ |
| . | HGBGM |
| . | HCT % |
| . | MCV $u^3$ |
| . | MCHuug |
| . | MCHC % |

| | | | | |
|---|---|---|---|---|
| SEG % | | 35-70% | POLYCHROM | |
| BAND % | | 00-11 % | HYPOCHROM | |
| LYMPH % | | 20-50% | POLK | |
| MONO % | | 00-14% | TARGET | |
| EOSIN % | | 00-05% | SPHERO | |
| BASO % | | 00-02% | ANISO | |
| ATYPL LYMPH | | KEY: | MICRO | |
| META % | | SLIGHT / FEW | MACRO | |
| MYELO % | | | SICKLE CELL | |
| PROS % | | | BASO SLIP | |
| BLASTS % | | | VACUOLES | |
| NRBC/100WBC | | | TOXIC GRAN | |
| OTHERS # | | INCREASED | PLATELETS | |
| TOTAL CELL COUNT | | NORMAL | | |
| NORMAL RBC | | DECREASED | | |

REMARKS

30

FIG. 5.

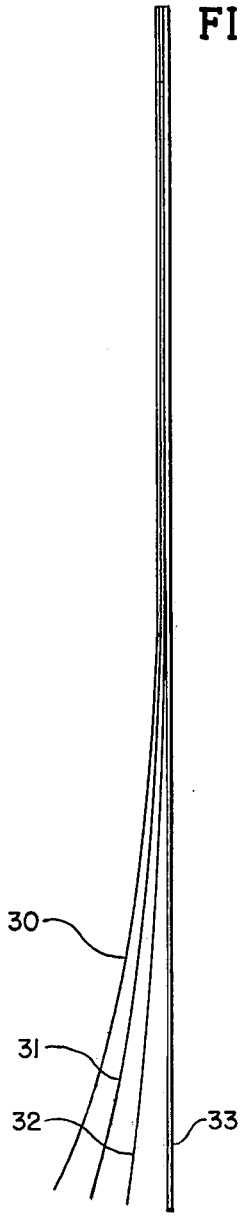

IMPACT LINE PRINTER

BACKGROUND OF THE INVENTION

Impact line printers are commonly used as readout devices for automated medical instrumentation, weighing devices, and digital computers. In the impact line printer, the type is carried on a continuously moving belt or drum and the paper and ribbon are locally impacted against the type face by a high velocity, small mass pivoted print hammer. The print hammer is driven by an actuator, typically an electrical solenoid, and makes contact with the paper for an extremely short time interval after which time it bounces back to its rest position. Since printing is "on the fly", i.e. the print drum or belt is constantly moving, a controller times the application of the current pulse to the actuator a sufficient time in advance such that the print hammer impacts the paper in time coincidence with the selected print character position.

In the current state of the art, impact line printer devices have been constructed with high print densities. However, the close spacing between the print hammers has been accomplished by an increase in cost and complexity. One type of prior art device uses sophisticated and expensive solenoid actuators having a very thin cross-sectional configuration so that the magnets may be stacked closely adjacent one another. Another type of prior art impact line printer device stacks the solenoids vertically, i.e. the solenoids are mounted one on top of each other. This arrangement substantially increases the manufacturing costs of the solenoid support structure, requires the use of long push rods from those solenoids stacked one or more solenoid layers away from the print hammers and creates an overall structure having a greater vertical dimension that may be tolerated in certain applications.

SUMMARY OF THE INVENTION

The present invention relates to an improved type of impact line printer in which common inexpensive cylindrical solenoids are closely packed to achieve an economically constructed impact printer providing both a high print density and high printing pressure. Printers constructed in accordance with this invention are particularly adapted to print multiple copy forms incorporating a sheet of relatively heavy card stock, e.g. 90 lb. ledger stock. This is accomplished by allowing the solenoid actuators to engage their associated print hammers at different distances from the hammer pivot axis. In the preferred embodiment described herein, a plurality of solenoids are mounted in the same vertical space. The external diameters of these solenoids are larger than the spacing of the print hammers, the solenoids being arranged in adjacent offset rows such that the first row respectively contacts their associated print hammers a distance $S_1$ from the hammer pivot axis and the second row respectively contacts their associated print hammers a distance $S_2$ from the hammer pivot axis. As described hereinafter, the distances $S_1$ and $S_2$ may be determined mathematically or empirically such that identical impact forces are produced on the printing medium using identical solenoids and driving currents. This packing arrangement has several significant advantages. The solenoids may be of inexpensive construction while providing a very high impact force upon the print hammer. The solenoids are mounted in the same vertical space thereby enabling the overall printer height to be minimized. A short push rod suffices to engage the solenoid armature with the print hammer. And, the frame holding the solenoids is a simple, economically manufactured structure comprising essentially four plates of a magnetic metal for providing a magnetic return path.

Another feature of this invention is that it provides a simple inexpensive print media drive mechanism of high reliability. A pair of pinch rollers, each rotatably mounted to a lever of plastic material, are aligned with a pair of resilient O-rings mounted to a driven roller. The lever includes an extended lever arm engaged by pinch roller drive solenoid so that when the solenoid is actuated, the pinch roller clamps the printing media to the resilient O-rings. The plastic lever arms provide a degree of flexibility to readily accomodate forms and cards and other print media of varying thickness. A pivoted pawl and ratchet wheel are used to drive the roller. A single spring is attached to the pawl to apply a line of force slightly above the pivot axis of the pawl. Accordingly this spring serves to both advance the pawl and apply a downward force thereupon to maintain the pawl in engagement with the ratchet wheel.

Another feature taught by the present invention is a unitary platen member of molded plastic which pivotally mounts a first set of print hammers interleaved with a second set of print hammers. This provides both an inexpensive member but one which is easily assembled while maintaining precise dimensional balances for the print hammers. The platen further includes an integral comb-like structure for positioning and guiding the print hammers. The top surface of the platen provides a guide plant for supporting the printing media within the impact line printer. Advantageously, the pinch roller lever arms are pivoted on the same axis as one set of the print hammers. As a result, the platen, print hammers and pinch roller arms form a mechanical sub-assembly which is inexpensive to manufacture while maintaining close dimensional tolerances.

BRIEF DESCRIPTION OF THE DRAWINGS

FIG. 3 illustrates a typical form used in medical laboratories pre-printed in a horizontal format;

FIG. 4 illustrates a typical form used in medical laboratories which is pre-printed in a vertical format;

FIG. 5 is a side elevational view of the forms shown in FIGS. 3 and 4;

DETAILED DESCRIPTION OF PREFERRED EMBODIMENT

Housing Configurations

Figure 1:
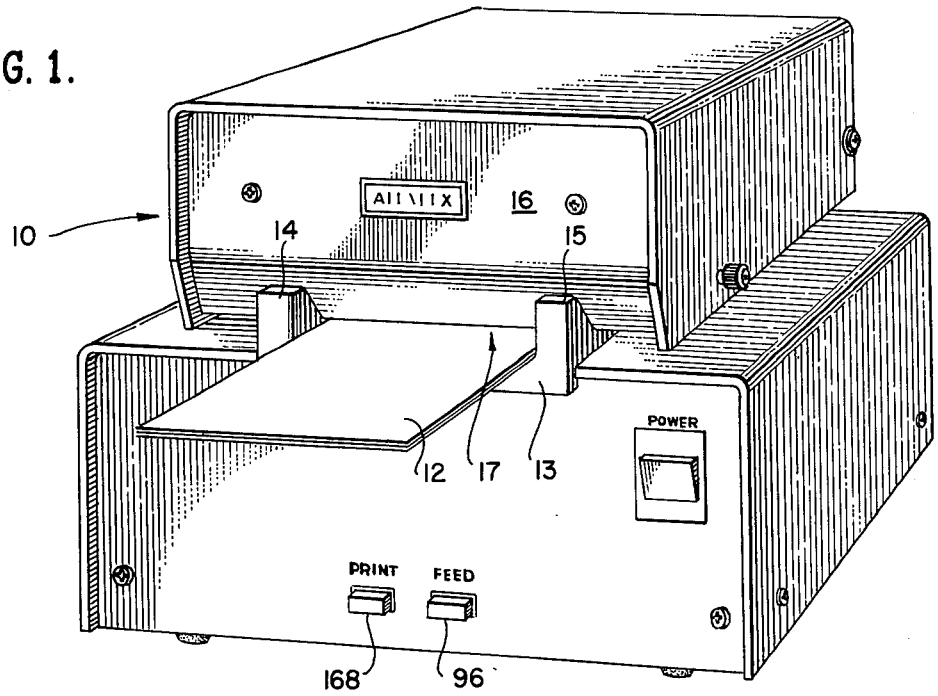
FIG. 1 is a perspective exterior view of an impact line printer constructed in accordance with this invention adapted to imprint paper, cards, and pre-printed forms or tickets of a predetermined size.
Figure 2:
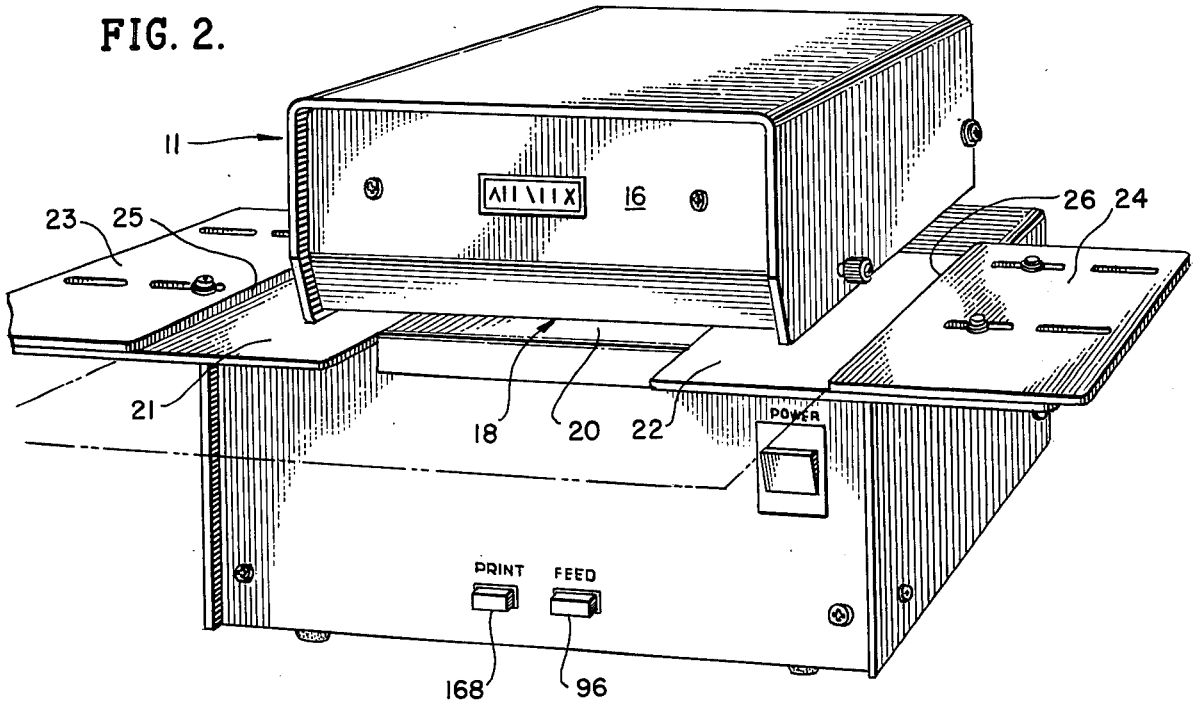
FIG. 2 is a perspective exterior view of an alternative configuration of the impact line printer constructed in accordance with this invention adapted to imprint larger sheets or printed forms of varying size and configuration.

FIGS. 1 and 2 illustrate the overall configuration of alternative housings 10 and 11 of the impact line printer constructed in accordance with this invention. Both housing configurations enclose the entire mechanism of the printer. Printer housing 10 is designed to imprint paper, cards, and pre-printed forms or tickets 12 of a predetermined size and format whereas printer housing 11 is designed to imprint larger sheets or printed forms of varying size and configuration.

As shown, the printer housing 10 includes a paper tray or platen 13 having spaced vertical shoulders 14, 15. These shoulders, the top surface of the platen (on which the printing medium 12 is resting) and bottom edge of the front housing panel 16 define a window 17 into which is inserted the paper, ticket, etc. to be imprinted.

Printer housing 11 provides a window opening 18 of substantially greater area for printing large sheets of paper (represented by the dashed lines). As shown, a flat surface of extended area is provided by the platen surface 20 and adjoining housing members 21 and 22. Adjustable guides 23, 24 are advantageously attached to members 21 and 22 to enable aligning the printed data uniformly with respect to side margins for a large variety of media sizes.

Different types of printing media

FIGS. 3, 4 and 5 illustrate two typical types of multiple copy, pre-printed forms. As shown, the rectangular form of FIG. 3 is pre-printed in a horizontal format and that of FIG. 4 is pre-printed in a vertical format. Any printed matter can of course be incorporated, the specific forms shown being typical of those utilized in medical laboratories. Referring to FIGS. 3 and 5, these forms may comprise sheets 30 and 31 of self imprint paper, a third sheet of carbon paper 32 and a bottom sheet 33 of a heavier card stock. By way of specific example, such self imprint media is sold by National Cash Register Co. It will of course be understood that the present invention is applicable to many types of forms and other printing media while finding particular utility with forms and the like incorporating a sheet of relatively heavy card stock, e.g. 90 lb. ledger stock.

The print drum

Figure 6:
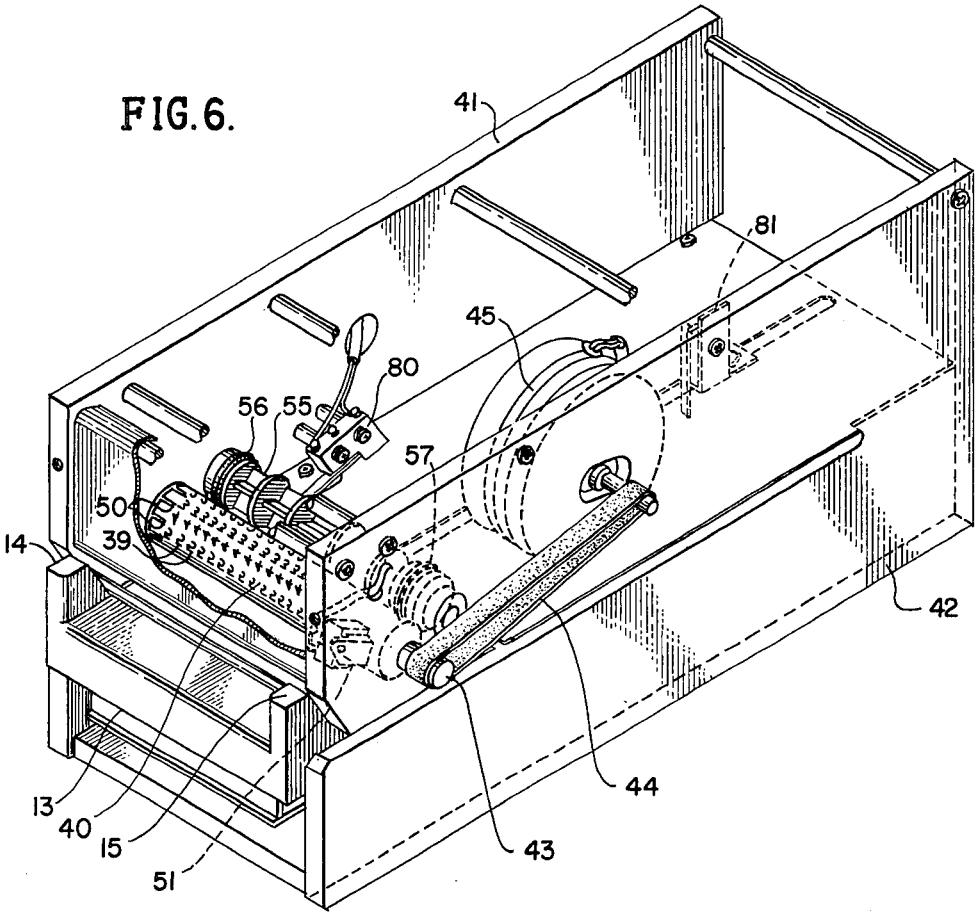
FIG. 6 is a perspective, partially cutaway interior view of an impact line printer constructed in accordance with this invention showing in particular the print drum and printing media drive assembly.
Figure 7:
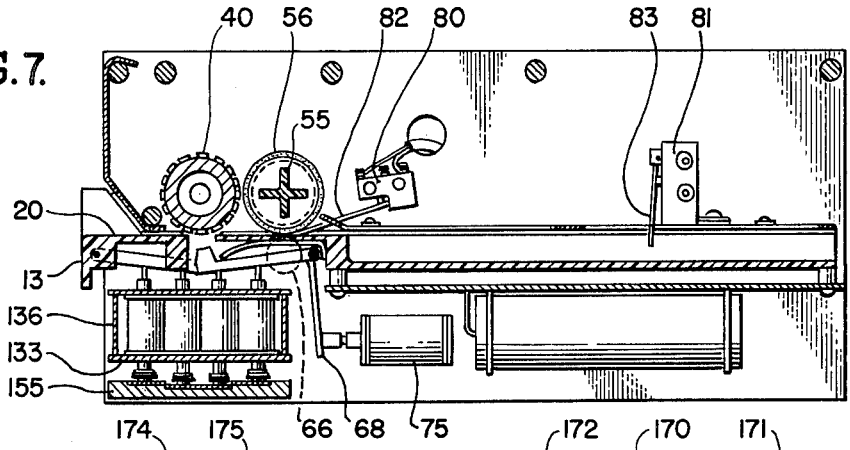
FIG. 7 is a vertical elevational, partial sectional view of the impact line printer shown in FIG. 6.

The overall mechanical assembly of the impact line printer is illustrated in FIGS. 6 and 7. The type characters 39 are physically mounted on the peripheral surface of drum 40 which is rotatably mounted in suitable bearings (not shown) retained in subframe walls 41 and 42. A coaxial pully 43 connected to the drum is located outside subframe wall 41 and is driven via a flexible belt 44 by constant speed motor 45 attached to the inside subframe wall 42.

A typical character pattern format is partially shown in FIG. 6 with the characters being formed in spaced rows of numbers, alphabet letters, symbols and the like. The type will normally be aligned as shown to print on the vertical form of FIG. 4 or aligned at right angles thereto for printing the horizontal form of FIG. 3. In the specific embodiment shown and described the drum is 1.01 inches in diameter and includes sixteen such rows equally spaced around the circumference of the drum, each row having nineteen characters equally spaced along the length of the drum having a typical hieght of 0.118 inches and width of 0.084 inches.

Figure 13:
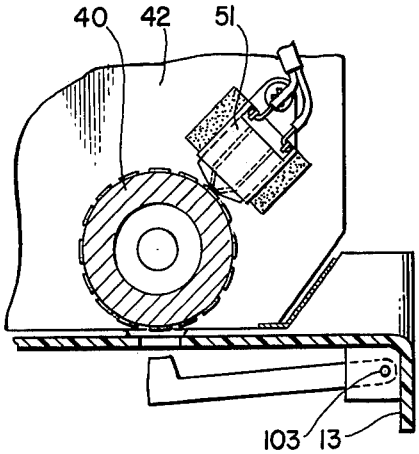
FIG. 13 is a side elevational view partially in section showing the details of the magnetic reluctance detector used to detect the rotational position of the print drum.

The print drum 40 further includes a series of spaced projections or timing bars 50 formed of a magnetic material at one or both ends thereof which are sensed by a magnetic reluctance type detector 51 mounted to subframe wall 42 (best shown in FIGS. 6 and 13) for detecting the rotational position of the print drum 50 at all times.

The print media drive assembly

A drive roller 55 is rotatably mounted in suitable bearings (not shown) retained in the subframe walls 41, 42. This roller is advantageously formed of a plastic such as Delrin and carries a pair of resilient O-rings 56, 57 at opposite ends. The printing media is clamped against these O-rings by a pair of pinch rollers 65, 66 (best shown in FIGS. 7, 8, 10 and 11) such that rotation of drive roller 55 causes the printing media to advance. These pinch rollers 65, 66 are respectively rotatably mounted to levers 67 and 68 each having an extended lever arm. Each of these levers are in turn pivotally mounted to platen 13 on pivot axis 69.

Figure 10:
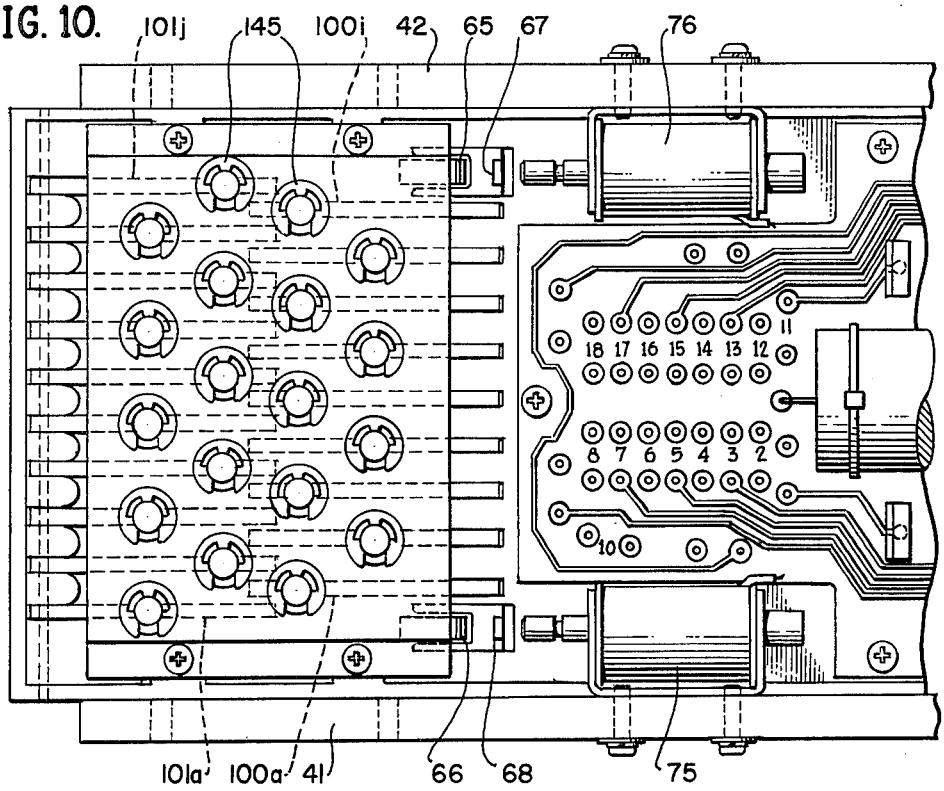
FIG. 10 is a partial bottom elevational view of the impact line printer showing in particular, the bottom of the platen, the pinch roller drive solenoids and the packing arrangement of the solenoids relative to the print hammers.

As shown in FIGS. 7 and 10 pinch roller drive solenoids 75, 76 are respectively mounted to the subframe walls 41, 42 so that their armatures respectively engage the ends of extended arms of levers 67, 68. The platen 13 includes respective openings 77, 78 (FIG. 11) aligned with the rollers 65, 66 and the O-rings 56, 57 on the drive roller 55. These openings permit the pinch rollers 65, 66 (when their respective lever arms are engaged by actuated solenoids 75, 76) to extend through the top surface 20 of the platen into engagement with the print media and clamp this media to the O-rings carried by the drive roller 55. As a result, rotation of the drive roller 55 will advance the print media a corresponding distance.

Both the rollers 65, 66 and the levers 67, 68 are advantageously formed from a plastic material such as Delrin. This material is very long wearing and in addition, imparts a degree of flexibility to the extending arms of levers 67, 68. As a result, forms and cards of varying thickness are readily incorporated in the impact line printer of this invention since any excess armature travel of the pinch roller drive solenoids 75, 76 will be accomodated by flexure of the lever arms.

Advantageously, the paper clamp and drive assembly is automatically responsive to insertion of the printing medium. In the specific embodiment shown, the insertion of the printing media into the window 17 or 18 of the front housing (as shown in FIGS. 1 and 2) is detected by a pair of microswitches 80, 81 (FIGS. 6 and 7). Microswitch 80 includes an actuator arm 82 which is engaged when the Paper form is inserted into the printer assembly on platen surface 20. Actuation of microswitch 80 enables (but does not turn on) power to the pinch roller drive solenoids 75, 76. Microswitch 81 includes an actuator arm 83 which is engaged when the print medium is fully inserted into the print assembly. Actuation of the arm 83 causes power to be actually supplied to the pinch roller drive solenoids 75, 76. Suitable control circuitry (well known in the art and therefore not shown) maintains those solenoids continuously actuated until the print medium has been advanced by the drive roller 55 past the actuator arm 82, at which time the microswitch 80 opens and disconnects power from the solenoids 75, 76.

Figure 12:
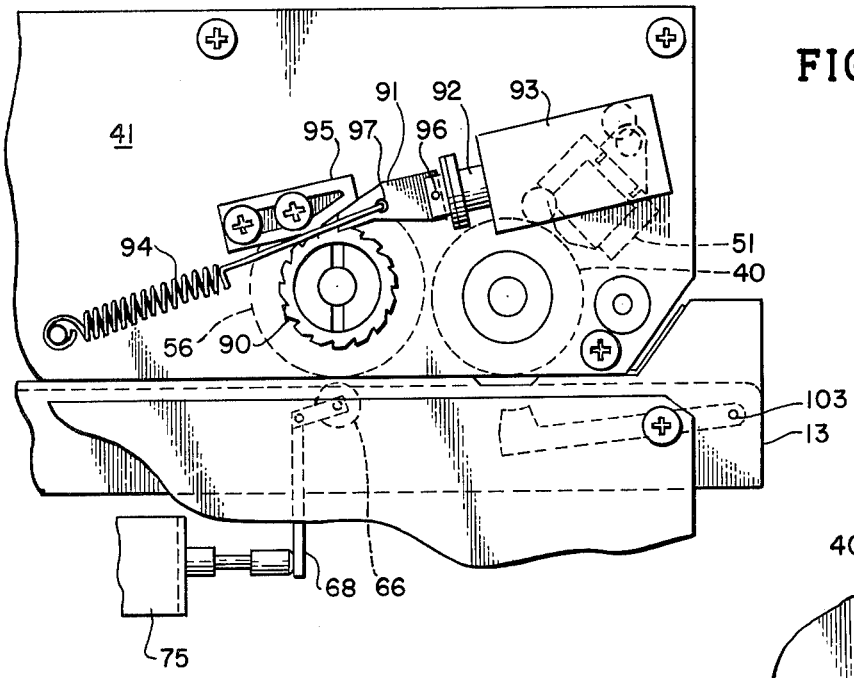
FIG. 12 is a right side elevational view showing the details of the ratchet and pawl used to drive the print media drive roller.

The mechanism for importing rotational motion to the drive roller 55 is shown in FIG. 12. A ratchet wheel 90, attached to the drive roller 55 shaft, is engaged by pawl 91 pivotally attached to the end of armature 92 of paper feed solenoid 93. Spring 94 is attached to pawl 91 at a point 97 so located that the line of the spring force is slightly above the pawl pivot axis 96 so that the single spring 94 suffices to both advance the pawl upon release of the armature 92 and apply a downward force upon the pawl to maintain it in engagement with the ratchet wheel 90 and pawl stop 95. Each time a pulse of current is supplied to feed solenoid 93, the drive roller 55 (and any paper stock clamped thereto) are caused to advance a distance corresponding to the spacing of the steps on the ratchet wheel 90 and the diameter of the O-rings 56, 57 carried by the drive roller 55. These current pulses are applied upon manual actuation of the front panel feed button 96 (shown in FIGS. 1 and 2) or automatically as part of the printing cycle.

The impact print hammer assembly

A significant feature of the present invention is that it provides an inexpensive, high density printer providing an unusually high impact force such that multiple copy and heavy weight forms may be printed without any reduction in printing pressure. Referring now to FIGS. 8, 9, 10 and 11 a first set of print hammers **100*a* - 100*a* are pivotally mounted to the platen member 13. As shown, these hammers are conveniently pivotally supported on the same axis 69 that supports the pinch roller levers. A second set of print hammers 101*a* - 101*j* are interleaved with the first set and pivotally mounted on a second pivot axis 103 also secured to platen 13. The print hammers are shown in their rest position by solid lines in FIGS. 7 and 8** and one print hammer is shown in its actuated state by a dashed lines.

Figure 8:
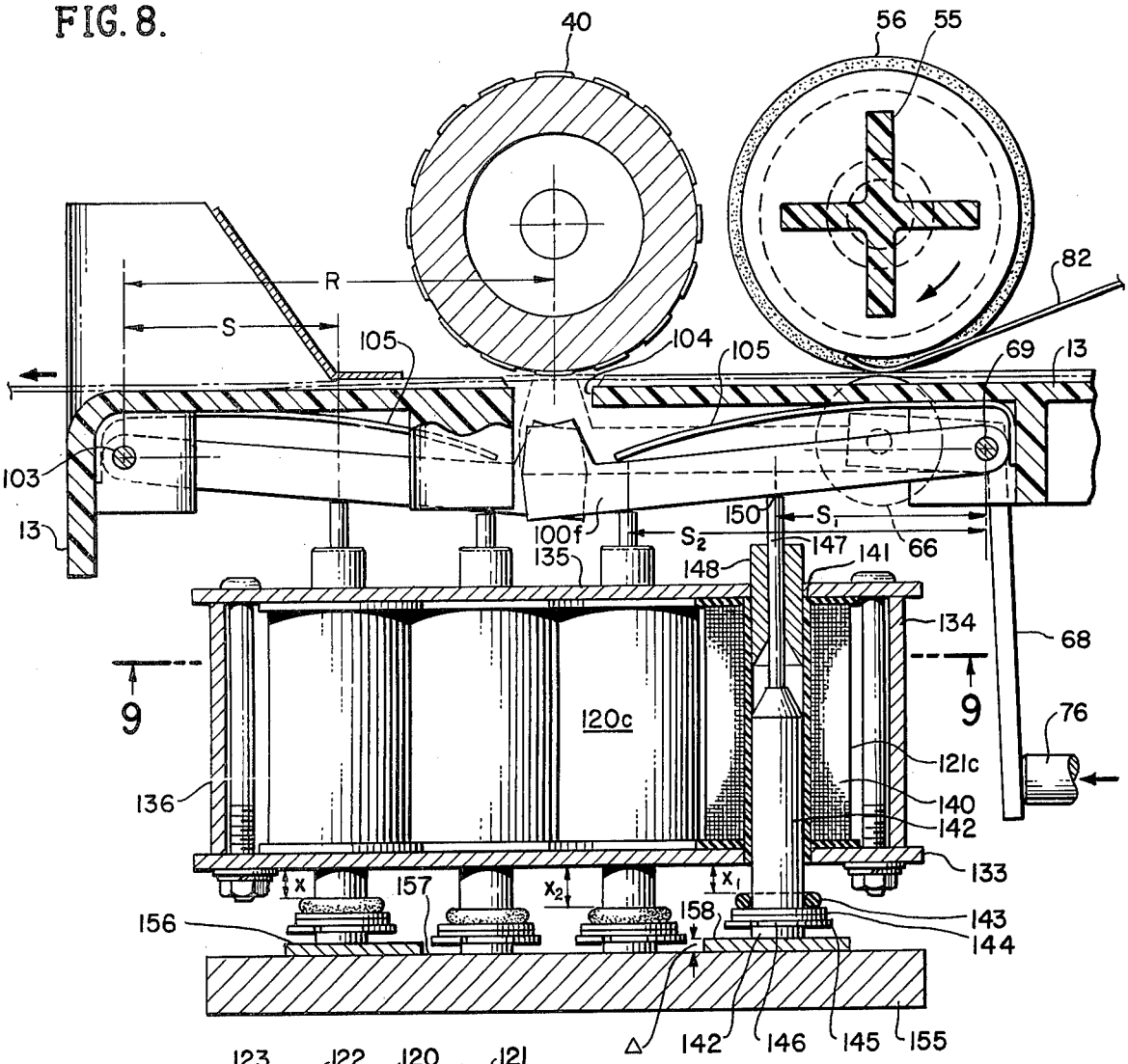
FIG. 8 is an enlarged vertical elevational partial sectional view showing the details of the print hammer and solenoid actuator mechanism.
Figure 9:
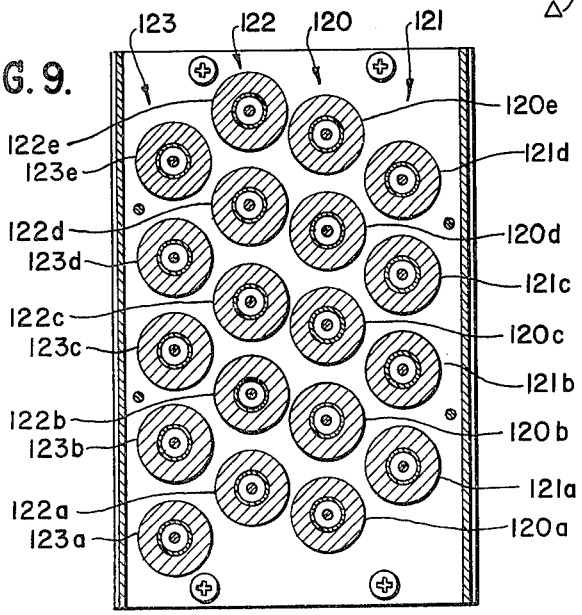
FIG. 9 is a horizontal sectional view taken along the lines 9—9 of FIG. 8 and shows the packing arrangement of the print solenoids.
Figure 11:
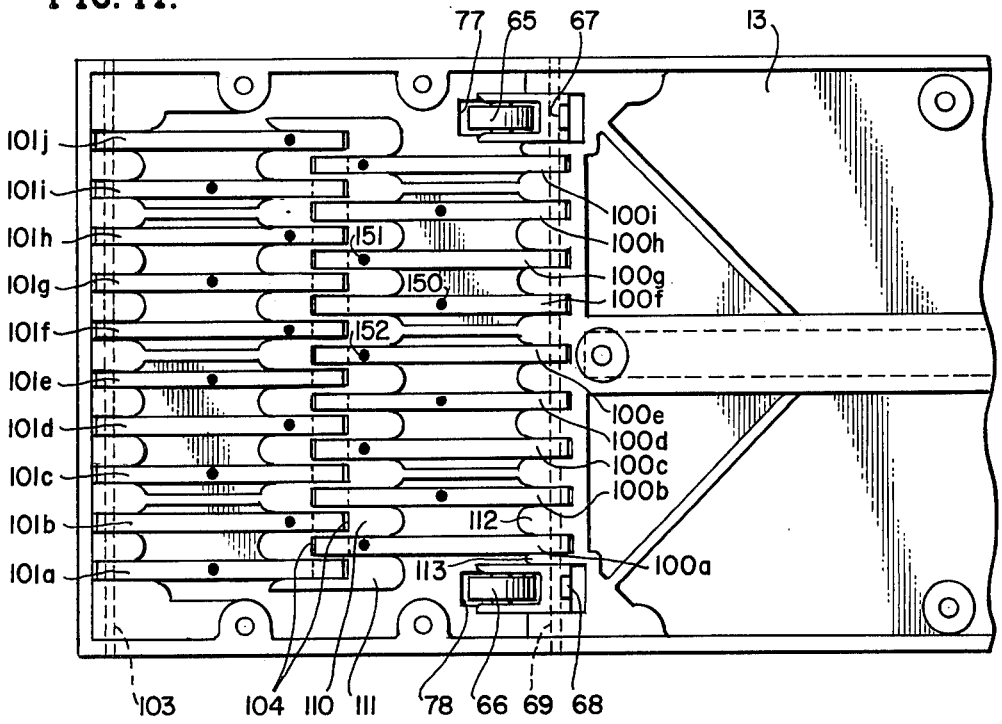
FIG. 11 is a top elevational view of the platen subassembly showing in particular the first and second set of print hammers pivotally mounted in the comb-like guides integrally formed in the platen.

The platen 13 includes a series of rectangular openings 104 (as seen from the bottom in FIG. 11 or from the side in the sectional view of FIG. 8). Each opening is large enough to accomodate the extending head portion of the print hammer such that the print hammer head (when the hammer is pivoted upwardly) can extend to slightly above the surface 20 of the platen 13 and thereby impact upon the underside of the print media. As a result, the print media is forced against whichever of the type characters is in juxtaposition therewith when the print hammer is driven by an associated print solenoid as described below.

Each of the print hammers is held in the rest position by an individual leaf spring 105. Each print hammer and associated leaf spring is prevented from sideways deflection by a comb-like hammer guide formed in the platen 13. As best shown in FIG. 11, these comb-like guide members accomodate as many hammers as there are type characters in each row of the print drum 40. For example, print hammer **100*a* and its associated leaf spring 105 are slidably retained between members 110, 111 and members 112, 113. Platen 13 is advantageously a molded plastic member of acrylonitrile butadiene-styrene with these members 110–113 being integrally formed with the bottom surface of platen 13**.

Each print hammer is selectively driven by an associated print solenoid. Basically, there are provided two rows 120, 121 of print solenoids **120*a* - 121*e* and 121*a* - 121*d* for a set of print hammers 100*a* - 100*i* pivoted on axis 69. Likewise, for the other set of print hammers 101*a* - 101*j* pivoted on axis 102, there are an additional two rows 122, 123 of print solenoids 122*a* - 122*e* and 123*a* - 123*e*. These print solenoids are mounted in a frame comprising metal plates 133, 134, 135 and 136**.. The plates are formed of a magnetic material and also serve as a magnetic circuit return path for the print solenoids.

The print solenoids are preferably of simple, inexpensive construction such as a cylindrical plastic bobbin upon which is directly wound insulated wire. In addition, since the magnetic flux produced by the solenoid is proportional to the number of turns wound on the solenoid, the solenoid should be of ample physical size to accomodate the requisite number of turns for achieving the desired force upon the solenoid plunger or armature. A representative solenoid of inexpensive construction is shown in FIG. 8 as comprising a solenoid coil 140 wound on a thin plastic bobbin 141. Bobbin 141 includes a cylindrical passageway in which the armature 142 is retained for longitudinal motion. The thin cylindrical wall of the bobbin 141 also provides an air gap between the armature 142 and the bottom plate 133. An O-ring 143 and shim washers 144 are secured at one end of the armature 142 by a keeper ring 145 held in an annular groove 146 formed near the end of the armature. Attached to the other end of each armature 142 is a non-magnetic push rod 147. This rod extends through a guide member 148 and is long enough to engage an associated print hammer at a predetermined distance from its pivot axis. When the coil 140 of the print solenoid is energized, the armature 142 is rapidly accelerated upward until the O-ring 143 impacts with the base plate 133. O-ring 143 thus (i) limits the travel of the armature to a distance X, (ii) cushions the impact of the armature with the base plate 133, and (iii) prevents the armature 142 from impacting upon the bottom of guide member 148. This impact of the armature with the base plate occurs before the head portion of the print hammer impacts with the paper, card, ticket or the like supported on the surface of the platen 13. Accordingly, the hammer moves through a predetermined distance in kinetic free flight until it impacts with the printing medium.

A significant feature of this invention is that the print solenoid packing arrangements (best shown in FIGS. 8

- 11) permits use of a large solenoid providing a substantial armature force and yet of simple, inexpensive construction while maintaining a high density print readout. Thus, note in FIGS. 8 and 9 that the individual cylindrical print solenoids are substantially larger in diameter than the spacing of the print hammers. It is therefore apparent that it would not be possible to mount this size solenoid in a single row while mounting all of the solenoids in the same vertical space and still maintain the same print hammer spacing. The packing array shown, wherein solenoids are arranged in adjacent offset rows is possible because of a recognition that a uniform print density can be obtained using identical solenoids and equal drive currents even though the solenoids engage their respective print hammers at different distances from their pivot axes. As shown in FIG. 8, the solenoid row 121 contacts their associated print hammers a distance $S_1$ from the pivot axis 69 and the solenoid row 120 contacts their associated print hammers a distance $S_2$ from the pivot axis 69. Solenoid 121*c*, for example, contacts print hammer 100*f* at point 150 as shown in FIGS. 8 and 11 whereas the immediately adjacent print hammers 100*e* and 100*g* are respectively contacted at points 151, 152 further removed from the pivot axis 69.

Based upon the mathematical equations which define the dynamic operation of the print solenoid and print hammer, it can be shown that:

$$\int F dx / \int D d\delta = W_1/W_2 (R^2/\rho)(S^2/R) + 1$$

where $F$ = force produced by the print solenoid
$X$ = distance traveled by the solenoid armature (see FIG. 8)
$D$ = compression force on printing media
$\delta$ = distance of compression upon printing media
$W_1$ = weight of the solenoid armature 143 and push rod 147
$W_2$ = weight of the print hammer
$\rho$ = radius of gyration of the print hammer about its pivot axis
$R$ = distance from the print hammer pivot axis to the center of its impact upon the print drum (see FIG. 8)
$S$ = distance from the print hammer pivot axis to the point of push rod contact (see FIG. 8)

Referring to equation (1) above, it will be seen that the printing density (defined by the integral $K\int D\, d\delta$) can be held at a constant value for different value of distance S if the solenoid armature travel distance X is adjusted. The remaining terms in the equation, namely, F, W, $W_2$, $\rho$ and R are constants in a given system.

Figure 15:
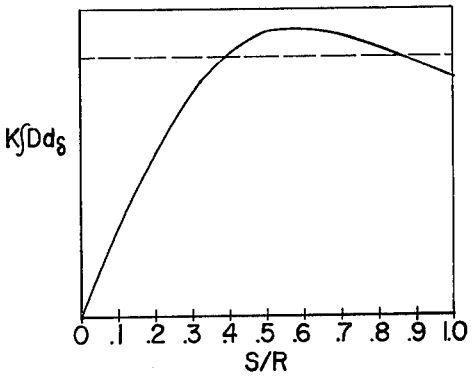
FIG. 15 is a graph showing the relationship between the impact print pressure $K\int D d\delta$ and the ratio of the distances S between the hammer pivot axis and the contact point of the print solenoid armature upon the print hammer to the length R of the print hammer.

The information contained in equation (1) is shown in graphical form in FIG. 15 in which the impact force $K\int D d\delta$ is plotted along the ordinate axis and the ratio of S/R is plotted along the abscicca. It will be seen that identical impact forces are produced for two discrete values of S/R.

Referring back to FIG. 8, a simple but effective means for providing respectively different travel distances $X_1$ and $X_2$ for the armature of the spaced rows 121, 123 and 120, 122 of print solenoids is the base plate 155 having a first step 156 on which the armatures of print solenoids 123*a* - 123*e* rest, step 157 on which the armature of the print solenoids 120*a* - 120*e* and 122*a* - 122*e* rest, and a third step 158 on which the armatures of print solenoids 121*a* - 121*d* rest. Steps 156 and 158 lie in a common plane distance $\Delta$ above the plane of step 157 whereby the armature plungers of solenoid row 120 and 122 travel a distance $X_1$ when energized whereas the plungers of solenoid row 121 and 123 travel a lesser distance $X_2$ as determined either empirically or mathematically from equation (1) above or a plotted graph as shown in FIG. 15 to obtain equal printing densities from the print solenoids packed at different distances from the hammer pivot axes.

Overall system operation

Figure 14:
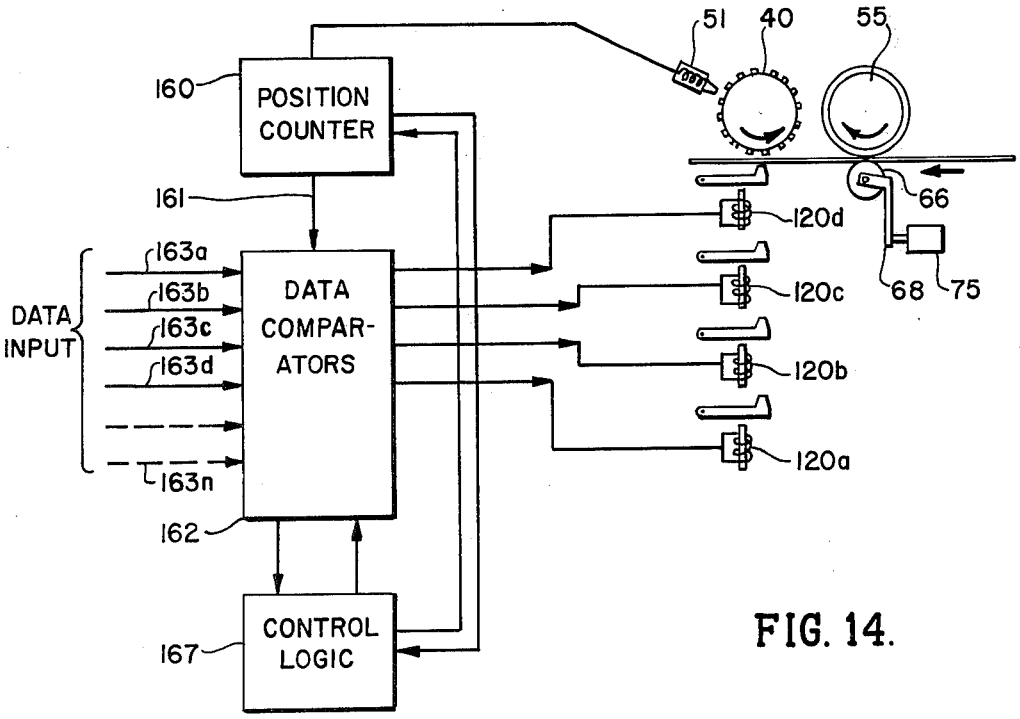
FIG. 14 is a simplified overall schematic of the system for controlling the print solenoids.

A block diagram schematic of the system of the main components for controlling the print solenoids is shown in FIG. 14. Position counter 160 is responsive to pulses produced by detector 51 and supplies a digital signal on lead 161 to the data comparator 162. The data to be imprinted is supplied from a keyboard, digital computer, memory storage device or the like and coupled to the data comparator via as many input leads 163*a*, 163*b*, 163*c*, 163*d* and 163*n* as there are type characters 39 (FIG. 6). Each of the print solenoids, 120*a*, 120*b*, 120*c* and 120*d* of which only four are shown for purposes of simplifying the drawing, are driven by the data comparator 162. Control logic 167 is coupled to the data comparator and position counter. The position of the print drum 40 is compared with the input data in the data comparator 162 which supplies drive currents to the print solenoids a sufficient time in advance so that the print hammer impacts the printing media in time coincidence with the print character position. The printing sequence may be automatically initiated by a master control keyboard, computer or the like (not shown) or by manual actuation of the print button 168 (shown in FIGS. 1 and 2).

Printer with ink ribbon supply

Figure 16:
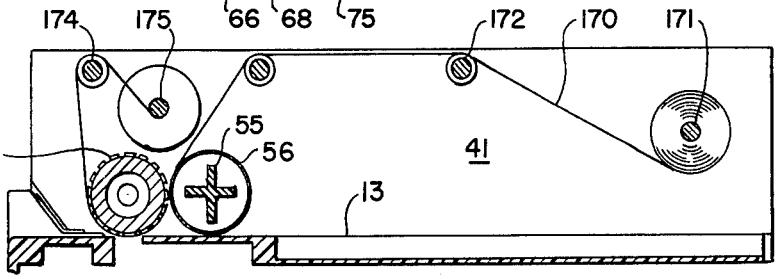
FIG. 16 is a vertical elevational partial sectional view showing the inclusion of an ink ribbon supply to the impact line printer.

Referring to FIG. 16, an ink ribbon supply may be conveniently incorporated if desired to imprint forms and other printing media which are not self imprinting. The ink ribbon 170 is wound upon a reel 171 rotatably supported on bearings (not shown) in the subframe walls 41 and 42. The ribbon 170 is passed over rollers 172, 173, around the print drum 40 and over roller 174 to a driven take up reel 175.

What is claimed is:

1. In an impact line printer wherein a plurality of pivoted print hammers impact a printing medium against moving type faces, the improvement comprising:

a first plurality of print hammer actuator solenoids for respectively engaging a first set of said print hammers of predetermined distance $S_1$ from the hammer pivot axis to push directly through a predetermined distance of armature movement $X_1$ on said hammers for impacting the printing media, a second plurality of print hammer actuator solenoids for respectively engaging a second set of said print hammers of predetermined different distance $S_2$ from the hammer pivot axis to push directly through a different predetermined distance of armature movement $X_2$ on said hammers for impacting the printing media, said distances of movement of solenoid armatures $X_1$ and $X_2$ as well as said distances from the hammer pivot axis $S_1$ and $S_2$ being appropriately selected to achieve substantially the equivalent impact printing forces against said moving type faces;

a platen subassembly comprising a unitary molded plastic platen member having a series of comb-like guides for said print hammers, said print hammers being pivoted within said guide by pivot means on said platen member, said platen member having a support surface for the printing media and a plurality of openings therethrough large enough to accommodate the heads of said print hammers so that energization of the actuator solenoid drives its associated hammer head through said opening to press the printing medium on said platen surface against one of said moving type faces; and means for driving said printing medium comprising a driven roller and clamp means for clamping said printing medium against said driven roller, said clamp means including a pinch roller rotatably mounted on a pivoted lever having an extended lever arm for engagement by an actuator means, said extended lever arm having a degree of flexibility so that printing media of varying thickness is accommodated by flexure of said lever arm.

2. In an impact line printer wherein a plurality of print hammers impact a printing medium against moving type face, the improvement comprising:

a plurality of print hammers each pivoted about an axis, and each having a head portion spaced from said axis for impacting said printing medium, a first plurality of print hammer actuator solenoids for respectively engaging a first set of said print hammers a predetermined distance $S_1$ from said axis, a second plurality of print hammer actuator solenoids for respectively engaging a second set of said print hammers a predetermined greater distance $S_2$ from said axis, said first plurality of solenoids having means for limiting movement of their armatures a predetermined distance $X_1$ in contact with said hammer, said hammers being adapted to continue movement in kinetic free flight to impact the media after said armature ceases movement, said second plurality of solenoids having means for limiting movement of their armatures a predetermined distance $X_2$ in contact with said hammer, said hammers being adapted to continue movement in kinetic free flight to impact the media after said armature ceases movement, and said distances $S_1$ and $S_2$ and $X_1$ and $X_2$ being selected to achieve substantially equivalent impact printing forces against said moving type face.

3. In the impact line printer of claim 2 wherein said first and second plurality of print hammer actuator solenoids are closely packed in the same vertical space and in first and second adjacent offset parallel rows.

4. In the impact line printer of claim 2 wherein:

said solenoids have a cylindrical configuration whose diameter is larger than the spacing of the print hammers.

5. In the impact line printer of claim 2 wherein the distance $X_2$ is greater than distance $X_1$ by a predetermined $\Delta$ dimension.

6. In the impact line printer of claim 5 wherein said predetermined $\Delta$ dimension is provided by a stepped plate engaged by the solenoid actuators at rest, said actuators adapted for engagement with the print hammers a distance $S_2$ from the print hammer pivot axis resting on a step which is $\Delta$ dimension lower than the step against which rest the solenoid actuators adapted for engagement with the print hammers a distance $S_1$ from the hammer pivot axis.

7. In the impact line printer of claim 6 wherein said distances $S_1$, $S_2$, $X_1$, $X_2$ are in accordance with the formula:

$$\int F dx / \int D d\delta = W_1/W_2 (R^2/\rho)(S^2/R) + 1$$

where $F$ = force produced by the print hammer actuator solenoid $X$ = distance traveled by the armature of said print hammer actuator solenoid $D$ = compression force on printing medium $\delta$ = distance of compression upon printing medium $W_1$ = weight of said solenoid armature $W_2$ = weight of said print hammer $\rho$ = radius of gyration of said print hammer about its pivot axis $R$ = distance from said print hammer pivot axis to the center of its impact upon said moving type face $S$ = distance from said print hammer pivot axis to the point of engagement with said solenoid armature.

8. In an impact line printer in accordance with claim 2 and further comprising:

a platen sub-assembly comprising a unitary molded plastic platen member having a series of comb-like guides for said print hammers, said print hammers being pivoted within said guides by pivot means on said platen member, said platen member having a support surface for the printing medium and a plurality of openings therethrough large enough to accommodate the heads of said print hammers.

9. In the impact line printer of claim 8 wherein:

a first set of print hammers is pivoted on a first axis mounted on said platen member and a second set of interleaved print hammers are pivoted on a second axis mounted on said platen member, said comb-like guides extending on both sides of said openings for guiding said two sets of print hammers.

10. In the impact line printer of claim 8 including:

means for driving said printing medium comrpising a driven roller and clamp means for clamping said printing medium against said driven roller, said clamp means including a pinch roller rotatably mounted on a lever, said lever being pivotally mounted on the same axis as said print hammer pivot axis.

11. In an impact line printer wherein a plurality of pivoted print hammers impact a printing medium against moving type face, the improvement comprising:

a first plurality of print hammer actuator solenoids of cylindrical configuration arranged in a first parallel row for respectively engaging a first set of said print hammers a predetermined distance $S_1$ from the hammer pivot axis, a second plurality of print hammer actuator solenoids of cylindrical configuration arranged in a second parallel row offset from said first parallel row for respectively engaging a second set of said print hammers a predetermined greater distance $S_2$ from the hammer pivot axis, said print hammer actuator solenoids having external diameters greater than the spacing of the print hammers and being closely packed in the same vertical space, means for providing a differential $\Delta$ dimension between the distance $X_1$ traveled by the armatures of said first plurality of print hammer actuator solenoids and the distance $X_2$ traveled by the armatures of said second plurality of print hammer actuator solenoids, said distances $S_1$, $S_2$, $X_1$ and $X_2$ being selected to achieve substantially equivalent impact printing forces against said moving type face, a platen sub-assembly comprising a unitary molded plastic platen member having a series of comb-like guides for said print hammers, said print hammers being pivoted within said guides by pivot means on said platen member, said platen member having a support surface for the printing media and a plurality of openings therethrough large enough to accomodate the heads of said print hammers so that energization of an actuator solenoid drives its associated hammer head through one of said openings to press the printing medium on said platen surface against one of said moving type face, and means for driving said printing medium comprising a driven roller and clamp means for clamping said printing medium against said driven roller, said clamp means including a pinch roller rotatably mounted on a pivoted lever having an extended lever arm for engagement by an actuator means, said extended lever arm having a degree of flexibility so that printing media of varying thickness is accomodated by flexure of said lever arm.

12. In the impact line printer of claim 11 wherein said means of driving said print medium further comprises:

a roller, a ratchet wheel attached to said roller, a pawl adapted to engage said ratchet wheel and pivotally connected to a releasable actuator member, a single spring engaging said pawl and applying a resultant force thereto, so that the component forces of said resultant force of the single spring suffices to both advance the pawl upon release of the actuator and maintain engagement of the pawl with the ratchet wheel.

* * * * *

UNITED STATES PATENT AND TRADEMARK OFFICE

CERTIFICATE OF CORRECTION

PATENT NO. : 4,070,963

DATED : Jan. 31, 1978

INVENTOR(S) : John H. Weaver

It is certified that error appears in the above-identified patent and that said Letters Patent are hereby corrected as shown below:

Column 7, line 30, delete "$\int Fdx/\int Dd\delta = W_1/W_2 (R^2\rho)(S^2/R)+1$"

and insert:

$$-- \int Fdx/\int Dd\delta = \frac{W_1}{W_2}\left(\frac{R}{\rho}\right)^2\left(\frac{S}{R}\right)^2 + 1 --$$

Column 10, line 7, delete "$\int Fdx/\int Dd\delta = W_1/W_2 (R^2\rho)(S^2/R)+1$"

and insert:

$$-- \int Fdx/\int Dd\delta = \frac{W_1}{W_2}\left(\frac{R}{\rho}\right)^2\left(\frac{S}{R}\right)^2 + 1 --$$

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*